US006476337B2

(12) United States Patent
Castonguay et al.

(10) Patent No.: US 6,476,337 B2
(45) Date of Patent: Nov. 5, 2002

(54) AUXILIARY SWITCH ACTUATION ARRANGEMENT

(75) Inventors: Roger N. Castonguay, Terryville, CT (US); David S. Christensen, Harwinton, CT (US); Girish Hassan, Seconderabad (IN); Dean A. Robarge, Southington, CT (US)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 09/792,986

(22) Filed: Feb. 26, 2001

(65) Prior Publication Data

US 2002/0117387 A1 Aug. 29, 2002

(51) Int. Cl.[7] ..... H01H 5/00

(52) U.S. Cl. ..... 200/400; 200/330

(58) Field of Search ..... 200/400, 337, 200/401, 503.2, 303, 312, 328–332; 335/132, 202

(56) References Cited

U.S. PATENT DOCUMENTS

| | | | | |
|---|---|---|---|---|
| 2,340,682 A | | 2/1944 | Powell | 200/147 |
| 2,719,203 A | | 9/1955 | Gelzheiser et al. | 200/144 |
| 2,937,254 A | | 5/1960 | Ericson | 200/114 |
| 3,158,717 A | | 11/1964 | Jencks et al. | 200/116 |
| 3,162,739 A | | 12/1964 | Klein et al. | 200/88 |
| 3,197,582 A | | 7/1965 | Norden | 200/50 |
| 3,307,002 A | | 2/1967 | Cooper | 200/116 |
| 3,517,356 A | | 6/1970 | Hanafusa | 335/16 |
| 3,631,369 A | | 12/1971 | Menocal | 337/110 |
| 3,803,455 A | | 4/1974 | Willard | 317/33 SC |
| 3,883,781 A | | 5/1975 | Cotton | 317/14 R |
| 4,129,762 A | | 12/1978 | Bruchet | 200/153 G |
| 4,144,513 A | | 3/1979 | Shafer et al. | 335/46 |
| 4,158,119 A | | 6/1979 | Krakik | 200/240 |
| 4,717,985 A | | 1/1988 | Demeyer | 361/96 |
| 4,733,211 A | | 3/1988 | Castonguay et al. | 335/192 |
| 4,733,321 A | | 3/1988 | Lindeperg | 361/96 |
| 4,760,220 A | * | 7/1988 | Fritsch et al. | 200/50 A |

(List continued on next page.)

FOREIGN PATENT DOCUMENTS

| | | |
|---|---|---|
| BE | 819 008 A | 12/1974 |
| BE | 897 691 A | 1/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 244 396 | 6/1987 |
| EP | 0 235 479 | 9/1987 |
| EP | 0 239 460 | 9/1987 |

(List continued on next page.)

*Primary Examiner*—P. Austin Bradley
*Assistant Examiner*—Lisa N Klaus
(74) *Attorney, Agent, or Firm*—Cantor Colburn LLP

(57) ABSTRACT

An auxiliary switch activation mechanism is provided for use with a circuit breaker having an auxiliary switch and an operating mechanism for opening and closing main electrical contacts. The auxiliary switch activation mechanism includes a lever having a first end removably connectable to the operating mechanism, a second end of said lever removably connectable to the auxiliary switch, and a spring, mechanically coupled to the lever, which imparts a rotational bias on the lever. The lever provides an assisting force to the operating mechanism for opening the main electrical contacts.

17 Claims, 7 Drawing Sheets

U.S. PATENT DOCUMENTS 4,764,650 A 8/1988 Bur et al. ..... 200/153 G
4,768,007 A 8/1988 Mertz et al. ..... 335/202
4,780,786 A 10/1988 Weynachter et al. ..... 361/87
4,831,221 A * 5/1989 Yu et al. ..... 200/553
4,870,531 A 9/1989 Danek ..... 361/93
4,883,931 A 11/1989 Batteux et al. ..... 200/148 R
4,884,047 A 11/1989 Baginski et al. ..... 335/10
4,884,164 A 11/1989 Dziura et al. ..... 361/97
4,900,882 A 2/1990 Bernard et al. ..... 200/147 R
4,910,485 A 3/1990 Bolongeat-Mobleu et al. ..... 335/195
4,914,541 A 4/1990 Tripodi et al. ..... 361/94
4,916,420 A 4/1990 Bartolo et al. ..... 335/172
4,916,421 A 4/1990 Pardini et al. ..... 335/185
4,926,282 A 5/1990 McGhie ..... 361/102
4,935,590 A 6/1990 Malkin et al. ..... 200/148 A
4,937,706 A 6/1990 Schueller et al. ..... 361/396
4,939,492 A 7/1990 Raso et al. ..... 335/42
4,943,691 A 7/1990 Mertz et al. ..... 200/151
4,943,888 A 7/1990 Jacob et al. ..... 361/96
4,950,855 A 8/1990 Bolonegeat-Mobleu et al. ..... 200/148 A
4,951,019 A 8/1990 Gula ..... 335/166
4,952,897 A 8/1990 Barnel et al. ..... 335/147
4,958,135 A 9/1990 Baginski et al. ..... 335/8
4,965,543 A 10/1990 Batteux ..... 335/174
4,983,788 A 1/1991 Pardini ..... 200/16 R
5,001,313 A 3/1991 Leclerq et al. ..... 200/148 B
5,004,878 A 4/1991 Seymour et al. ..... 200/144 R
5,029,301 A 7/1991 Nebon et al. ..... 335/16
5,030,804 A 7/1991 Abri ..... 200/323
5,053,590 A * 10/1991 Vierling ..... 200/293
5,057,655 A 10/1991 Kersusan et al. ..... 200/148 B
5,077,627 A 12/1991 Fraisse ..... 361/93
5,083,081 A 1/1992 Barrault et al. ..... 324/126
5,095,183 A 3/1992 Raphard et al. ..... 200/148 A
5,103,198 A 4/1992 Morel et al. ..... 335/6
5,115,371 A 5/1992 Tripodi ..... 361/106
5,120,921 A 6/1992 DiMarco et al. ..... 200/401
5,132,865 A 7/1992 Mertz et al. ..... 361/6
5,138,121 A 8/1992 Streich et al. ..... 200/293
5,140,115 A 8/1992 Morris ..... 200/308
5,153,802 A 10/1992 Mertz et al. ..... 361/18
5,155,315 A 10/1992 Malkin et al. ..... 200/148 R
5,166,483 A 11/1992 Kersusan et al. ..... 200/144 A
5,172,087 A 12/1992 Castonguay et al. ..... 335/160
5,178,504 A 1/1993 Falchi ..... 411/553
5,184,717 A 2/1993 Chou et al. ..... 200/401
5,187,339 A 2/1993 Lissandrin ..... 200/148 F
5,198,956 A 3/1993 Dvorak ..... 361/106
5,200,724 A 4/1993 Gula et al. ..... 335/166
5,210,385 A 5/1993 Morel et al. ..... 200/146 R
5,239,150 A 8/1993 Bolongeat-Mobleu et al. ..... 200/148 R
5,260,533 A 11/1993 Livesey et al. ..... 200/401
5,262,744 A 11/1993 Arnold et al. ..... 335/8
5,280,144 A 1/1994 Bolongeat-Mobleu et al. ..... 200/148 R
5,281,776 A 1/1994 Morel et al. ..... 200/144
5,296,660 A 3/1994 Morel et al. ..... 200/146 R
5,296,664 A 3/1994 Crookston et al. ..... 200/401
5,298,874 A 3/1994 Morel et al. ..... 335/8
5,300,907 A 4/1994 Nereau et al. ..... 335/172
5,310,971 A 5/1994 Vial et al. ..... 200/244
5,313,180 A 5/1994 Vial et al. ..... 335/16
5,317,471 A 5/1994 Izoard et al. ..... 361/105
5,331,500 A 7/1994 Corcoles et al. ..... 361/93
5,334,808 A 8/1994 Bur et al. ..... 200/50
5,341,191 A 8/1994 Crookston et al. ..... 335/16
5,347,096 A 9/1994 Bolongeat-Mobleu et al. ..... 200/148 B
5,347,097 A 9/1994 Bolongeat-Mobleu et al. ..... 200/148 B
5,350,892 A 9/1994 Rozier ..... 200/144 B
5,357,066 A 10/1994 Morel et al. ..... 200/17 R
5,357,068 A 10/1994 Rozier ..... 200/148 R
5,357,394 A 10/1994 Piney ..... 361/72
5,361,052 A 11/1994 Ferullo et al. ..... 335/172
5,373,130 A 12/1994 Barrault et al. ..... 200/147 R
5,379,013 A 1/1995 Coudert ..... 335/17
5,424,701 A 6/1995 Castonguary et al. ..... 335/172
5,438,176 A 8/1995 Bonnardel et al. ..... 200/400
5,440,088 A 8/1995 Coudert et al. ..... 200/303
5,449,871 A 9/1995 Batteux et al. ..... 200/401
5,450,048 A 9/1995 Leger et al. ..... 335/132
5,451,729 A 9/1995 Onderka et al. ..... 200/18
5,457,295 A 10/1995 Tanibe et al. ..... 200/293
5,467,069 A 11/1995 Payet-Burin et al. ..... 335/42
5,469,121 A 11/1995 Payet-Burin ..... 335/16
5,475,558 A 12/1995 Barjonnet et al. ..... 361/64
5,477,016 A 12/1995 Baginski et al. ..... 200/43.11
5,479,143 A 12/1995 Payet-Burin ..... 335/202
5,483,212 A 1/1996 Lankuttis et al. ..... 335/132
5,485,343 A 1/1996 Santos et al. ..... 361/115
D367,265 S 2/1996 Yamagata et al. ..... D13/160
5,493,083 A 2/1996 Olivier ..... 200/17 R
5,504,284 A 4/1996 Lazareth et al. ..... 200/50 R
5,504,290 A 4/1996 Baginski et al. ..... 200/401
5,510,761 A 4/1996 Boder et al. ..... 335/172
5,512,720 A * 4/1996 Coudert et al. ..... 200/400
5,515,018 A 5/1996 DiMarco et al. ..... 335/16
5,519,561 A 5/1996 Mrenna et al. ..... 361/105
5,534,674 A 7/1996 Steffens ..... 218/154
5,534,832 A 7/1996 Duchemin et al. ..... 335/16
5,534,835 A 7/1996 McColloch et al. ..... 335/172
5,534,840 A 7/1996 Cuingnet ..... 337/1
5,539,168 A 7/1996 Linzenich ..... 200/303
5,543,595 A 8/1996 Mader et al. ..... 200/401
5,552,755 A 9/1996 Fello et al. ..... 335/18
5,581,219 A 12/1996 Nozawa et al. ..... 335/132
5,604,656 A 2/1997 Derrick et al. ..... 361/187
5,608,367 A 3/1997 Zoller et al. ..... 335/132
5,784,233 A 7/1998 Bastard et al. ..... 361/36

FOREIGN PATENT DOCUMENTS

EP 0 258 090 3/1988
EP 0 264 313 4/1988
EP 0 264 314 4/1988
EP 0 283 189 9/1988
EP 0 283 358 9/1988
EP 0 291 374 11/1988
EP 0 295 155 12/1988
EP 0 295 158 12/1988
EP 0 309 923 4/1989
EP 0 313 106 4/1989
EP 0 313 422 4/1989
EP 0 314 540 5/1989
EP 0 331 586 9/1989
EP 0 337 900 10/1989
EP 0 342 133 11/1989
EP 0 367 690 5/1990
EP 0 371 887 6/1990
EP 0 375 568 6/1990
EP 0 394 144 10/1990
EP 0 394 922 10/1990
EP 0 399 282 11/1990
EP 0 407 310 1/1991
EP 0 452 230 10/1991
EP 0 555 158 8/1993
EP 0 560 697 9/1993

| | | |
|---|---|---|
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 512 582 | 3/1983 |
| FR | 2 553 943 | 4/1985 |
| FR | 2 592 998 | 7/1987 |
| FR | 2 410 353 | 6/1989 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| RU | 1 227 978 | 4/1986 |
| WO | 92/00598 | 1/1992 |
| WO | 92/05649 | 4/1992 |
| WO | 94/00901 | 1/1994 |

* cited by examiner

AUXILIARY SWITCH ACTUATION ARRANGEMENT

BACKGROUND

Electrical circuit breakers are utilized throughout electrical power transmission and distribution systems to interrupt the flow of electric current to a protected load. A conventional circuit breaker includes a pair of separable (main) contacts that open in response to a fault condition (e.g., overcurrent or ground fault) to interrupt the current flow. Auxiliary position switches are typically mounted to the frame of the circuit breaker to provide an electrical signal indicative of the position of the main contacts.

A typical auxiliary switch includes a separable contact structure in which one contact is disposed on a stationary contact arm, while the other contact is disposed on a movable contact arm. A spring generally urges the movable contact arm about a pivot to position the contacts in a normally open or normally closed state. A plunger engages the movable contact arm for opening the separable contacts in the normally closed configuration or for closing the separable contacts in the normally open configuration. When the plunger is depressed, it moves the movable contact arm to open or close the contacts accordingly.

Typically, the plunger of the auxiliary switch is actuated by a solid mechanical link to an operating mechanism in the circuit breaker, which acts to separate the main contacts of the circuit breaker. The plunger is displaced upon rotation or displacement of the movable contact arm. The displacement of the auxiliary switch plunger separates (or joins) the contacts in the auxiliary switch, which causes an electrical signal to be sent to a local or remote alarm, light or other monitoring device, thereby indicating the position of the separable contacts in the circuit breaker.

The force used to overcome the auxiliary switch spring and actuate the auxiliary switch is the same force used to separate the contacts in the circuit breaker. This force is typically provided by main springs in the operating mechanism of the circuit breaker. However, the use of the force provided by the main springs to actuate the auxiliary switch reduces the amount of force available to separate the contacts. Increasing the size of the main springs can compensate for the reduced force. However, increasing the size of the springs may not be desirable, since a corresponding increase in the size of the circuit breaker housing may result.

BRIEF SUMMARY

The above discussed and other drawbacks and deficiencies are overcome or alleviated by an auxiliary switch activation mechanism provided for use with a circuit breaker having an auxiliary switch and an operating mechanism for opening and closing main electrical contacts. In an exemplary embodiment of the present invention, the auxiliary switch activation mechanism includes a lever having a first end removably connectable to the operating mechanism, a second end of said lever removably connectable to the auxiliary switch, and a spring, mechanically coupled to the lever, which imparts a rotational bias on the lever. The lever provides an assisting force to the operating mechanism for opening the main electrical contacts.

In another embodiment, first end of the lever is removably connectable to a crank in the operating mechanism. The lever further comprises a foot which is slidingly engageable with a nose surface on the crank. The foot remains in contact with the nose surface when the circuit breaker main electrical contacts are in a closed position. Further, the foot is slidingly engageable with a bottom surface of the crank, and is removably engageable with the bottom surface when the circuit breaker main contacts are in an open or tripped position.

In yet another embodiment, the lever is substantially L-shaped and further includes a lip, which is removingly engageable with the auxiliary switch. The lever imparts a rotational force on the crank when the circuit breaker main electrical contacts are caused to be opened or tripped from a closed position.

BRIEF DESCRIPTION OF THE DRAWINGS

Referring to the exemplary drawings wherein like elements are numbered alike in the several Figures.

DETAILED DESCRIPTION OF THE INVENTION

Figure 1:
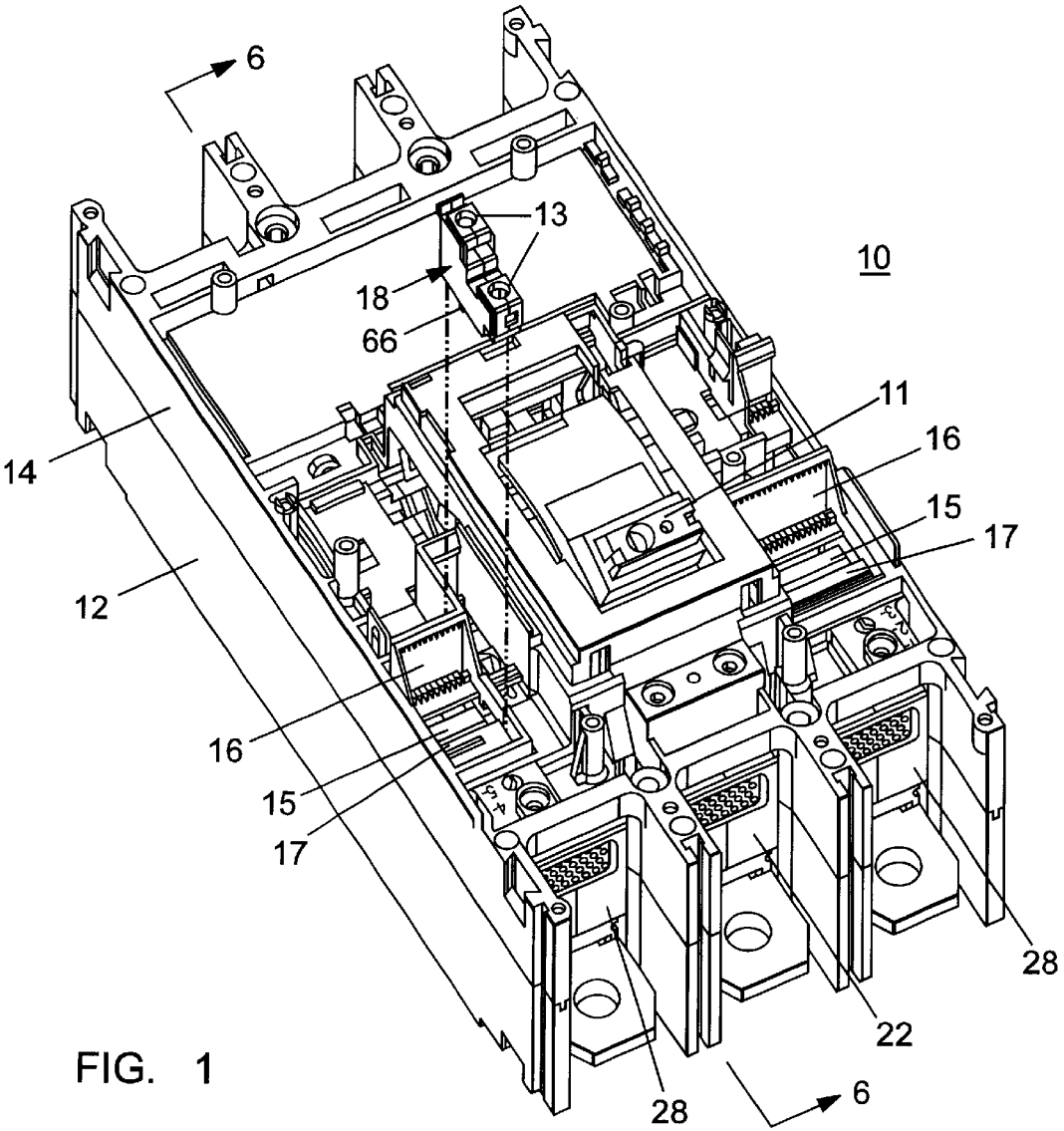
FIG. 1 is a partially exploded, perspective view of a circuit breaker including an auxiliary switch.

Referring initially to FIG. 1, there is shown a typical circuit breaker 10 having a base 12, a midcover 14, auxiliary switch sockets 16 formed within the midcover 14 and an exemplary auxiliary switch 18 positioned over its intended final installed position within the circuit breaker base 12. In a 3-pole system (i.e., corresponding with three phases of current), three rotary cassettes (outboard cassettes 28 and center cassette 22) are concurrently operated by an operating mechanism, as described hereinafter. A toggle handle 11 allows for the manual operation of cassettes 22, 28. Auxiliary switch 18 includes a pair of electrical contacts (not shown) for external connection to a control/monitoring circuit (not shown) and a depressible plunger 66, which opens and closes the auxiliary switch contacts. Sockets 16 include an aperture 15, through which plunger 66 extends, and a ledge 17 upon which the bottom of auxiliary switch 18 rests.

Figure 2:
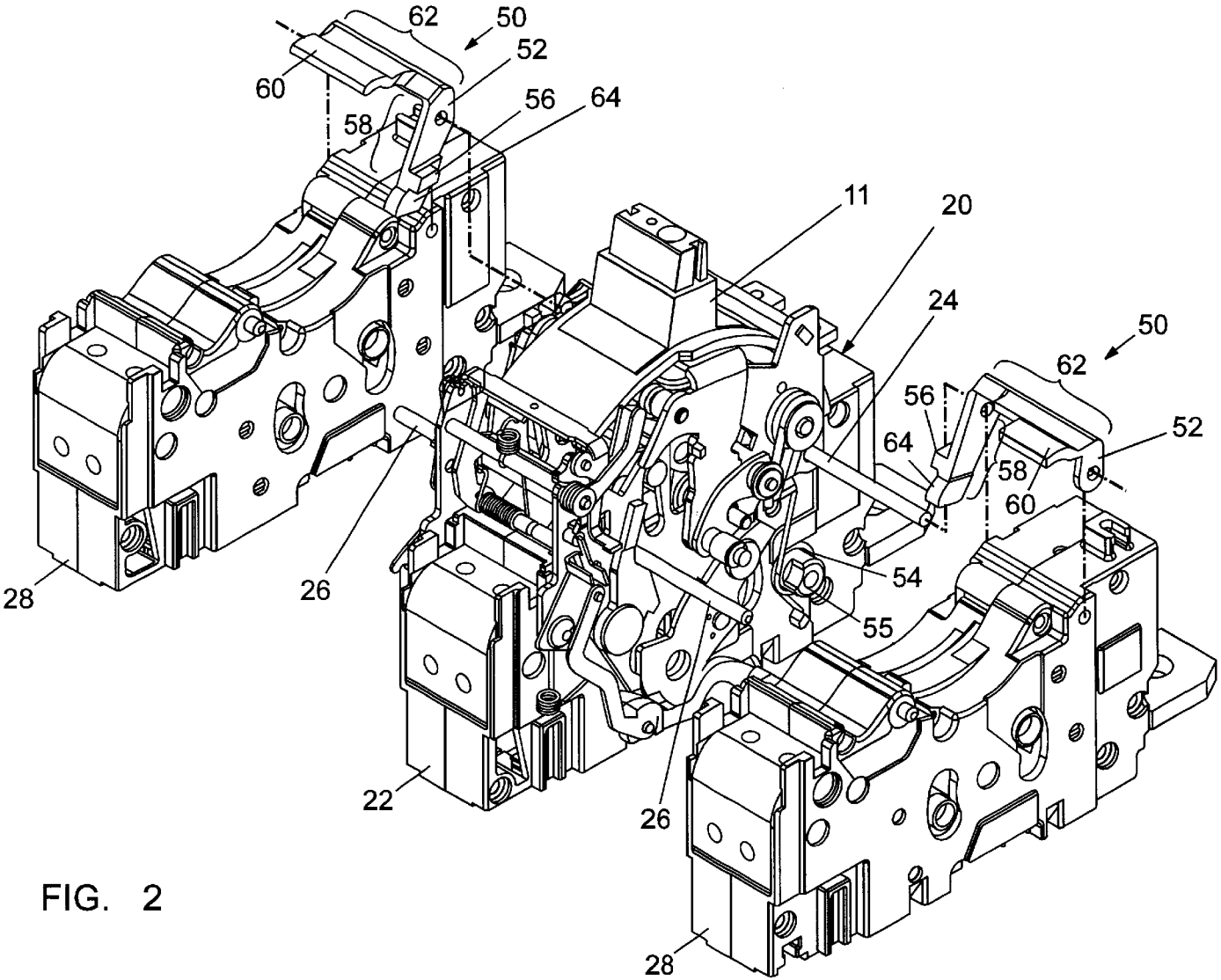
FIG. 2 is a partially exploded perspective view of three cassettes contained in the circuit breaker shown in FIG. 1, depicting the auxiliary switch actuation mechanism.
Figure 3:
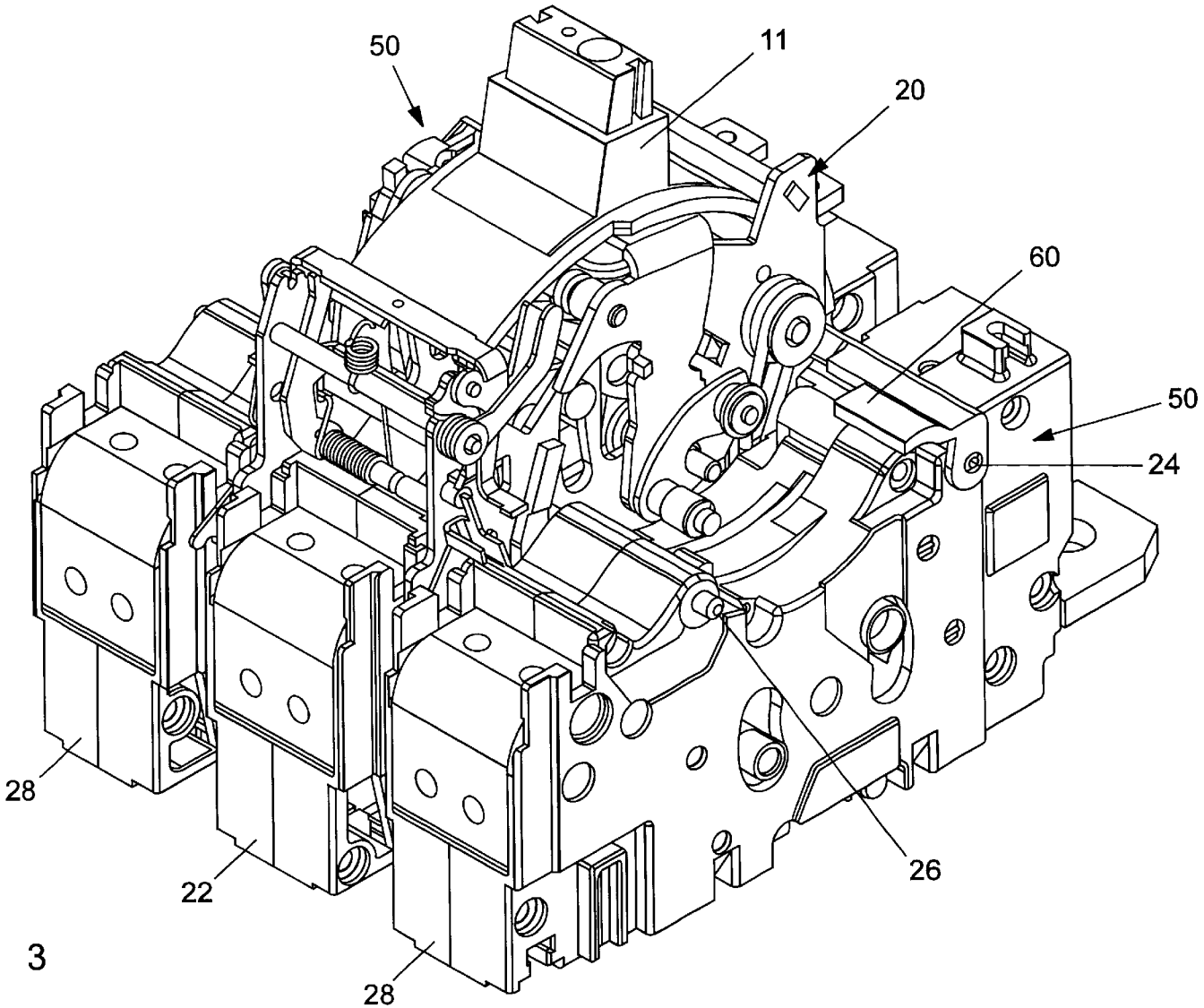
FIG. 3 is a perspective view of the cassettes and auxiliary switch actuation mechanism shown in FIG. 2.

Referring now to FIGS. 2 and 3, a circuit breaker operating mechanism 20 is shown positioned over center cassette 22 by rods 24 and 26. Rods 24 and 26 also position outboard cassettes 28 adjacent to center cassette 22. FIG. 2 also illustrates an auxiliary switch actuation mechanism 50. The auxiliary switch actuation mechanisms 50 feature a pair of pivotally mounted levers 52, which fit over the outboard cassettes 28 and pivot about rod 24. Each actuation mechanism 50 includes an activation spring 54, which is secured about post 55 and positioned on the outside surfaces of center cassette 22. Each lever 52 is generally L-shaped and further includes a lip 60 located along a horizontal section 62 thereon. The function of the lip 60 will be described in greater detail later. Lever 52 also has a foot 64 located at the end of its vertical section 58 and adjacent the lobe 56.

Figure 4:
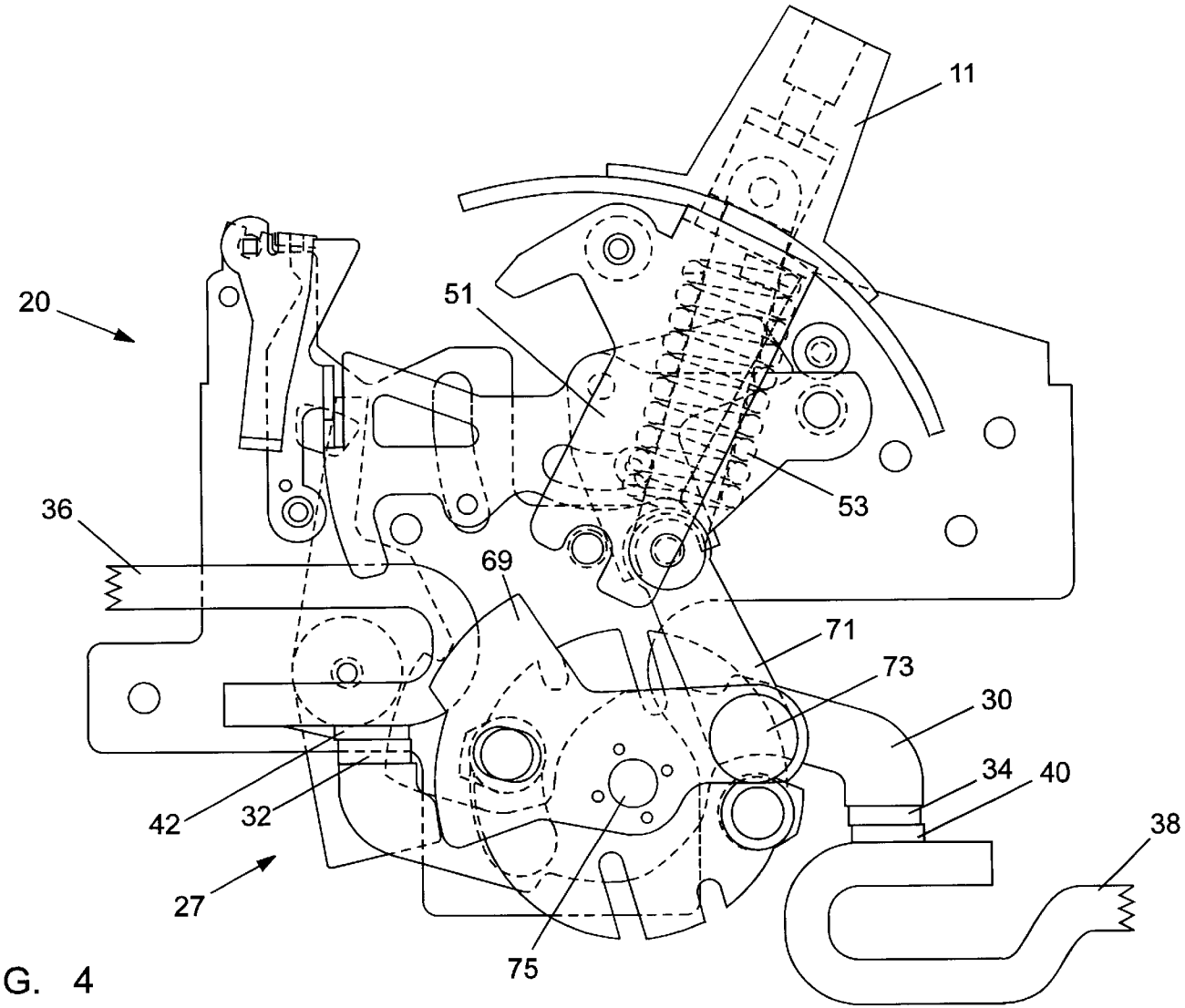
FIG. 4 is a side view of a circuit breaker operating mechanism shown mounted on a rotary contact assembly, illustrating the contacts in a closed position.
Figure 5:
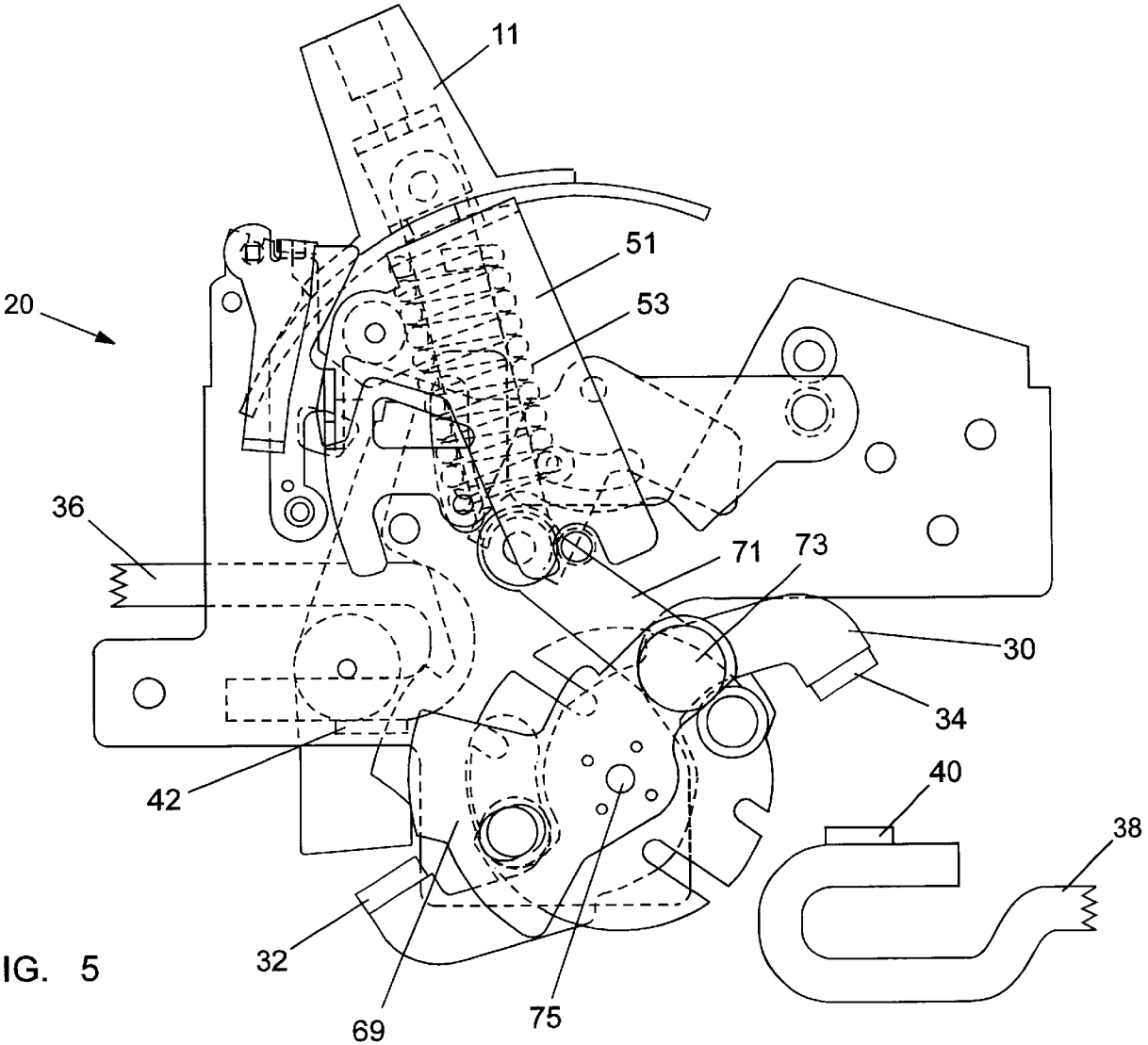
FIG. 5 is another side view of the operating mechanism shown mounted on a rotary contact assembly, illustrating the contacts in an open position.

Referring now to FIGS. 4 and 5, center cassette 22 includes a rotary contact assembly 27 including a rotary contact arm 30 rotatably mounted therewithin. It should be noted that each cassette, including outboard cassettes 28, feature rotary contact assemblies 27. However, for ease of description, rotary contact assembly 27 in FIGS. 4 and 5 is the one included in center cassette 22. Rotary contact assembly 27 of center cassette 22 further includes a crank 69 on each side of center cassette 22. Each crank 69 is connected to a lower link 71 in operating mechanism 20 through a rivet 73 and pivots (in unison with rotary contact arm 30) about a center point 75.

An electrical contact 32 is secured to one end of a rotary contact arm 30, which is maintained between cranks 69, while another electrical contact 34 is secured to the opposite end of the rotary contact arm 30. Rotary contact assembly 27 also includes a current carrying strap 36 extending from a load side of the cassette 22 and a current carrying strap 38 extending from a line side of the cassette 22. A fixed contact 40 arranged proximate to contact 34 is electrically connected to the line side current carrying strap 38. A fixed contact 42 arranged proximate to contact 32 is electrically connected to the load side current carrying strap 36. The rotary contact arm 30 rotates to bring the contacts mounted on the rotary contact arm (movable contacts) 32 and 34 into and out of electrical connection with their associated fixed contacts 42 and 40, respectively. When the fixed and movable contacts 32 and 42, and 34 and 40 are touching (closed), electrical current passes from the line side current carrying strap 38 to the load side current carrying strap 36 via the closed contacts. When contacts 32 and 42, and contacts 34 and 40 are separated (opened), the flow of electrical current from the line side current carrying strap 38 to the load side current carrying strap 36 is interrupted.

FIG. 4 illustrates the rotary contact assembly 27 in the closed position. Toggle handle 11 is shown positioned to the right. The toggle handle 11 is rigidly connected to a handle yoke 51 which, in turn, is connected to a set of powerful mechanism springs 53 linked by a drive connector (not shown). The drive connector connects springs 53 to other components in the operating mechanism 20, including rotary contact assembly 27. FIG. 5 illustrates the rotary contact assembly 27 in the open position, with the toggle handle 11 shown positioned to the left.

Figure 6:
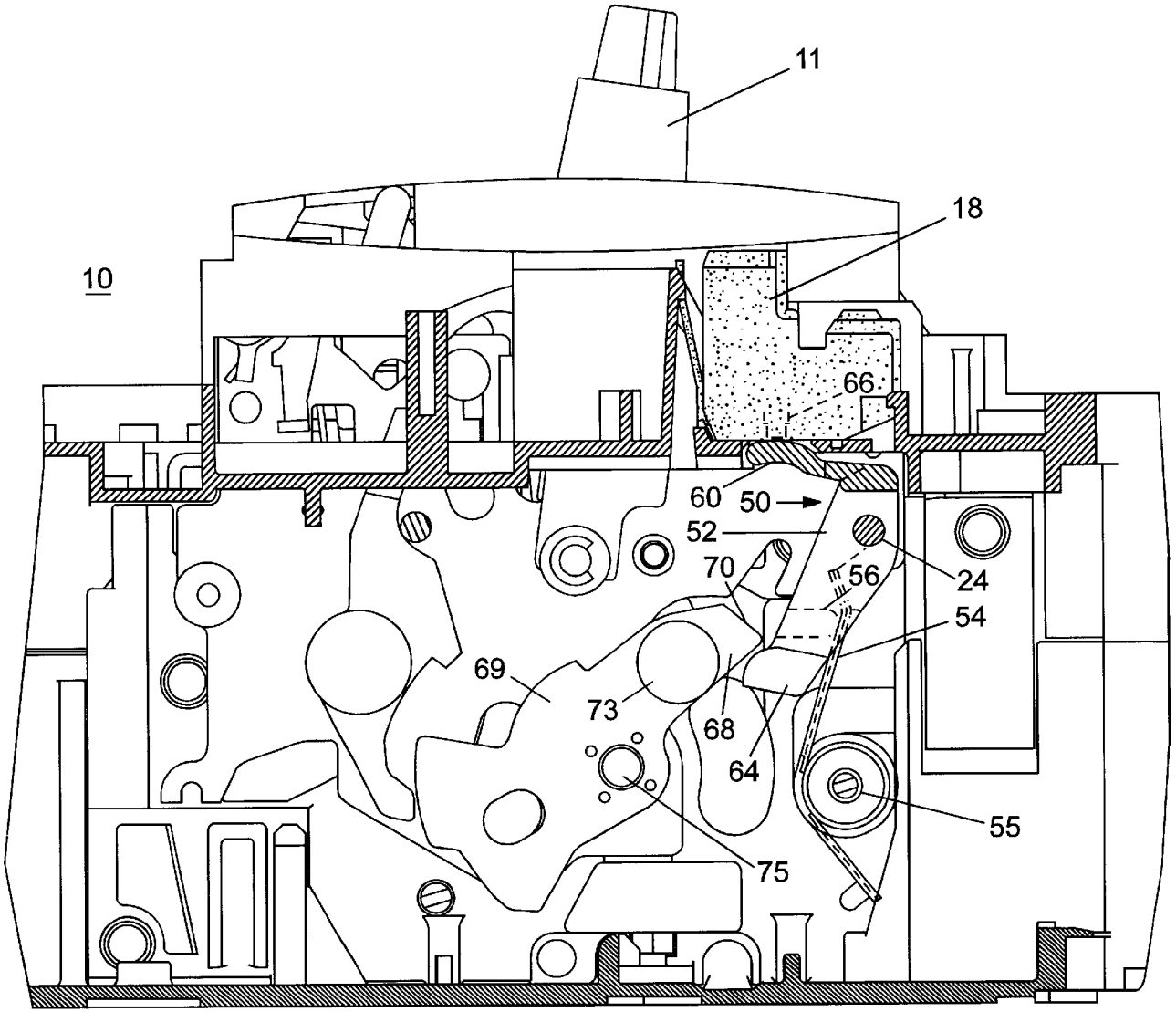
FIG. 6 is a cross-sectional, side elevational view of the circuit breaker of FIG. 1, taken along line 6—6, which generally illustrates the interconnection of the operating mechanism and the auxiliary switch actuation mechanism when the operating mechanism is tripped.
Figure 7:
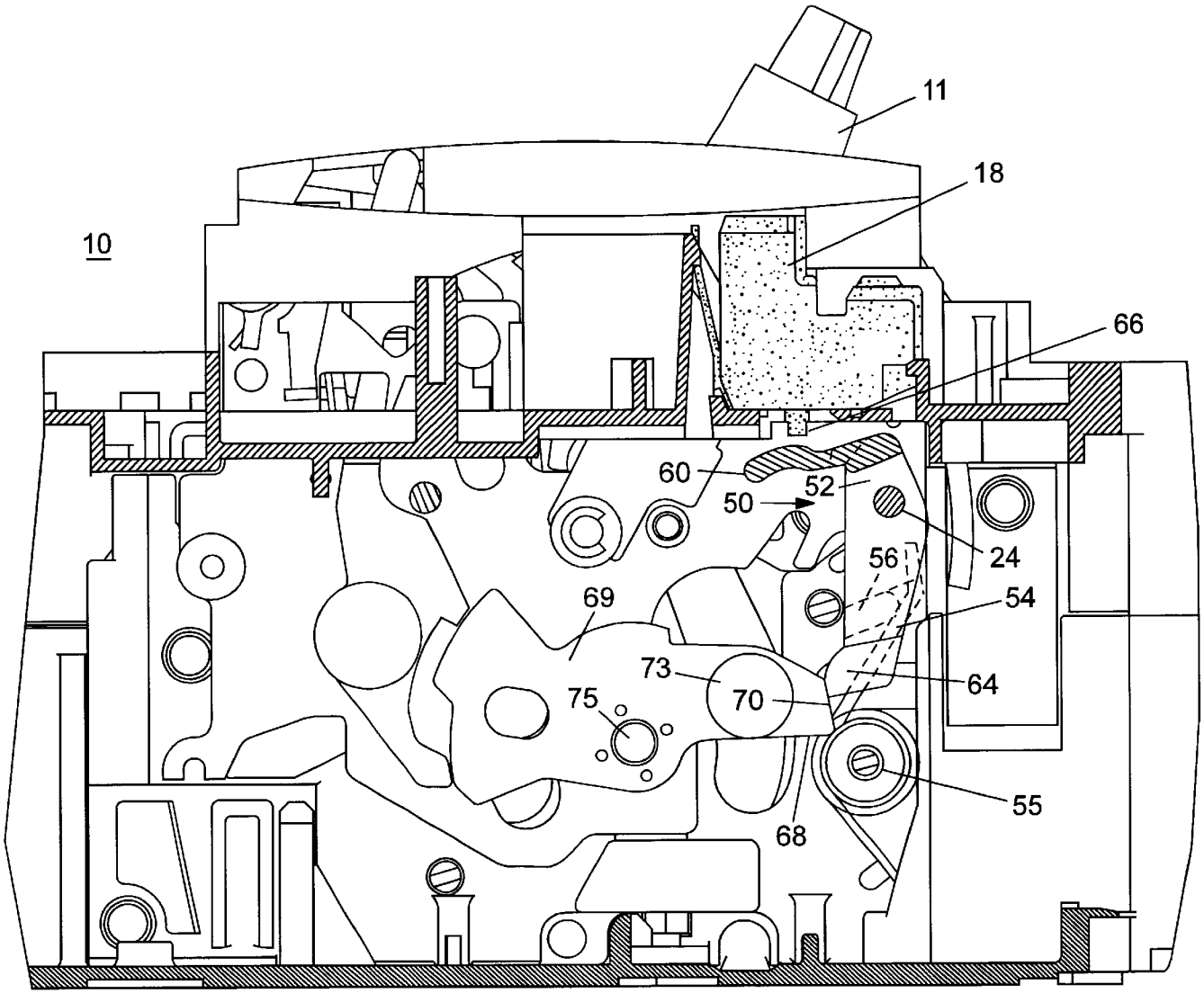
FIG. 7 is another partial cross-sectional, side elevational view of the circuit breaker of FIG. 1, taken along line 6—6, which illustrates the interconnection of the operating mechanism and the auxiliary switch actuation mechanism when the operating mechanism is closed.

Referring now to FIGS. 6 and 7, the auxiliary switch actuation mechanism 50 is shown in operation with crank 69 of rotary contact assembly 27. For ease of description, only one of two actuation mechanisms 50 will be described in operational detail. However, it should be understood that each actuation mechanism 50 functions identical to, and simultaneously with, the other actuation mechanism.

When the circuit breaker 10 is in the open position, as depicted in FIG. 6, the lever 52 is biased in a clockwise direction by activation spring 54, which engages lobe 56, located along a vertical section 58 (FIG. 2) on lever 52. The biasing force of spring 54 pivots the lever 52 in a clockwise direction (with respect to the views in FIGS. 6 and 7), thereby causing the lip 60 to completely engage and depress plunger 66 into auxiliary switch 18. When depressed, plunger 66 either opens or closes contacts (not shown) in auxiliary switch 18, as the case may be, and provides an appropriate indication as to the status of the main circuit breaker contacts. In the open position, lever 52 is completely disengaged from crank 69.

FIG. 7 illustrates the arrangement of the operating mechanism and the lever 52 when the main circuit breaker contacts are in the closed position. As the main breaker contacts are closed, the operating mechanism 20 is rotated clockwise, causing a bottom surface 68 of crank 69 to initially engage the foot 64 of lever 52. This action then causes lever 52 to rotate in a counterclockwise direction, opposite to the biasing force of spring 54. As the lever 52 is rotated counterclockwise, its foot 64 slides along the bottom surface 68 of crank 69 until it finally comes into contact with a nose surface 70 of crank 69. When the operating mechanism 20 has completed its rotational motion to the closed position, it can be seen that the lip 60 of lever 52 has sufficiently rotated counterclockwise such that it has disengaged from and released plunger 66. When released, the plunger 66 correspondingly closes or opens the auxiliary switch 18 contacts.

The nose surface 70 of crank 69 requires very little force to bias the foot 64 of lever 52 in a counterclockwise direction. Once the main breaker contacts are in the closed position, they may be subsequently opened manually or tripped open during a fault or overcurrent condition. In such a case, the crank 69 begins to rotate counterclockwise, back toward the position shown in FIG. 6. During this counterclockwise rotation, the nose surface 70 of crank 69 slides across the foot 64 of lever 52 (in the opposite direction of that during the closing sequence). As soon as the nose surface 70 is clear of the foot 64, the lever 52 is released and caused to be rotated in a clockwise direction by activation spring 54. The foot 64, being rotated clockwise in this manner, then catches the bottom surface 68 of crank 69 and imparts an additional counterclockwise force on the crank 69, thereby assisting the main springs in the operating mechanism 20 to rotate the contact arm and separate the main contacts. Finally, the crank 69 and lever 52 return to their original positions as depicted in FIG. 4 with the plunger 66 once again completely depressed by lip 60.

The embodiments as described hereinbefore provide a reliable actuation arrangement for actuating contacts in a circuit breaker auxiliary switch while requiring a minimal amount of energy from the operating mechanism. Further, the actuation arrangement assists the operating mechanism during that part of the opening cycle when the energy of the operating mechanism is at its lowest.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An auxiliary switch activation mechanism for use with a circuit breaker having an auxiliary switch and an operating mechanism, said operating mechanism for opening and closing main electrical contacts, said auxiliary switch activation mechanism comprising:

a lever having a first end removably connectable to said operating mechanism;

a second end of said lever removably connectable to said auxiliary switch; and a spring, mechanically coupled to said lever, said spring imparting a rotational bias on said lever, wherein said lever provides an assisting force to said operating mechanism for opening said main electrical contacts.

2. The auxiliary switch activation mechanism of claim 1, wherein said first end of said lever is removably connectable to a crank in said operating mechanism.

3. The auxiliary switch activation mechanism of claim 2, wherein said lever further comprises a foot which is slidingly engageable with a nose surface on said crank.

4. The auxiliary switch activation mechanism of claim 3, wherein said foot remains in contact with said nose surface when the circuit breaker main electrical contacts are in a closed position.

5. The auxiliary switch activation mechanism of claim 3, wherein said foot is slidingly engageable with a bottom surface of said crank.

6. The auxiliary switch activation mechanism of claim 5, wherein said foot is removably engageable with said bottom surface when the circuit breaker main contacts are in an open or tripped position.

7. The auxiliary switch activation mechanism of claim 1, wherein said lever is substantially L-shaped.

8. The auxiliary switch activation mechanism of claim 7, wherein said lever further comprises a lip which is removingly engageable with the auxiliary switch.

9. The auxiliary switch activation mechanism of claim 6, wherein said lever imparts a rotational force on said crank when the circuit breaker main electrical contacts are caused to be opened or tripped from a closed position.

10. A circuit breaker, comprising:

a first electrical contact;

a second electrical contact arranged proximate to said first electrical contact;

an operating mechanism configured to separate said first and second electrical contacts, said operating mechanism including a rotary contact assembly operatively connected to said first electrical contact; and an auxiliary switch activation mechanism, said auxiliary switch activation mechanism further comprising:

a lever having a first end removably connectable to a crank in said rotary contact assembly;

a second end of said lever removably connectable to an auxiliary switch; and an activation spring, mechanically coupled to said lever, said activation spring imparting a rotational bias on said lever.

11. The circuit breaker of claim 10, wherein said lever further comprises a foot which is slidingly engageable with a nose surface on said crank.

12. The circuit breaker of claim 11, wherein said foot remains in contact with said nose surface when the circuit breaker main electrical contacts are in a closed position.

13. The circuit breaker of claim 11, wherein said foot is slidingly engageable with a bottom surface of said crank.

14. The circuit breaker of claim 13, wherein said foot is removably engageable with said bottom surface when the circuit breaker main contacts are in an open or tripped position.

15. The circuit breaker of claim 10, wherein said lever is substantially L-shaped.

16. The circuit breaker of claim 15, wherein said lever further comprises a lip which is removingly engageable with the auxiliary switch.

17. The circuit breaker of claim 14, wherein said lever imparts a rotational force on said bell crank when the circuit breaker main electrical contacts are caused to be opened or tripped from a closed position.

* * * * *